United States Patent [19]

Welsch et al.

[11] Patent Number: 4,843,975

[45] Date of Patent: Jul. 4, 1989

[54] STORAGE SHELF

[75] Inventors: John H. Welsch, Moscow; Robert J. Cohn, Dallas, both of Pa.

[73] Assignee: InterMetro Industries Corporation, Wilkes-Barre, Pa.

[21] Appl. No.: 75,936

[22] Filed: Jul. 22, 1987

[51] Int. Cl.[4] ..... A47B 85/00

[52] U.S. Cl. ..... 108/24; 108/111; 211/41; 211/188

[58] Field of Search ..... 108/24, 91, 92, 111, 108/53.1, 53.3; 211/188, 194, 153, 41

[56] References Cited

U.S. PATENT DOCUMENTS

| | | | |
|---|---|---|---|
| 933,180 | 9/1909 | Johnson | 211/41 X |
| 2,702,127 | 2/1953 | Pastorius et al. | 211/41 |
| 2,844,344 | 7/1958 | Strob et al. | 211/188 X |
| 3,141,552 | 7/1964 | Ettlinger, Jr. | 211/41 |
| 3,217,890 | 11/1965 | Maslow | 211/41 |
| 3,306,463 | 2/1967 | Maslow | 211/41 X |
| 3,349,924 | 10/1967 | Maurer et al. | 211/41 |
| 3,424,111 | 1/1969 | Maslow . | |
| 3,433,184 | 3/1969 | Addy | 108/53.3 |
| 3,523,508 | 8/1970 | Maslow . | |
| 3,640,229 | 2/1972 | Bell . | |
| 3,927,769 | 12/1975 | Maslow | 108/144 X |
| 4,467,927 | 8/1984 | Nathan | 108/91 X |
| 4,635,563 | 1/1987 | Hand et al. | 108/111 |

FOREIGN PATENT DOCUMENTS

| | | | |
|---|---|---|---|
| 874287 | 8/1942 | France | 108/92 |
| 1338331 | 11/1973 | United Kingdom | 108/53.3 |

*Primary Examiner*—Kenneth J. Dorner
*Assistant Examiner*—José V. Chen
*Attorney, Agent, or Firm*—Fitzpatrick, Cella, Harper & Scinto

[57] ABSTRACT

A single piece, molded plastic shelf is configured with spaced channels and ribs having slots to provide upward and downward fluid communication with items stored thereon. A generally flat tray of molded plastic is provided with a flange extending upwardly around its periphery. Rib sections are spaced periodically about the tray, forming generally parallel channels to the rib sections to allow free circulation of air and free drainage of liquids from the underside of stored items. Each rib section extends upwardly a greater extent than the peripheral flange. Slots are provided in each rib section further to allow the free circulation of air or other gases while restricting drainage of liquids.

11 Claims, 3 Drawing Sheets

STORAGE SHELF

BACKGROUND OF THE INVENTION

1. Field of the Invention

The present invention relates to shelving, and more particularly, to shelving for use in the storage of articles for which it is desirable quickly to reach the ambient temperature and from which it is desirable to drain liquids that may spill or condense on the shelving.

2. Description of the Prior Art

Many different types of shelves are known. Generally, however, the avialable shelves have disadvantages in their poor ability to freely circulate air around stored articles and to provide proper drainage of liquid about the articles. The following examples of known shelf structures are representative.

U.S. Pat. No. 3,927,769 (Maslow) relates to a metal shelf formed with ribbing and providing for air circulation around the lower surfaces of supported objects. Apertures are formed between the rib sections and open at a level lower than a peripheral flange formed about the shelf. While offering many advantages, this shelf structure has what might be considered certain drawbacks including that the peripheral flange is higher than apertures opening between the rib sections. Therefore, liquid spilled on the shelf will flow through the apertures and drain out to items stored directly below on the lower shelf.

U.S. Pat. No. 4,467,927 (Nathan) relates to a molded tray for display stands. The tray or shelf has a flat surface formed with a supporting and reinforcing grid. Apertures in the tray are said to reduce the total amount of plastic used in the shelf. Any item stored on this shelf will be exposed to air circulating about its bottom surface only through the apertures formed in the shelf. Furthermore, a flange extending about the periphery of the shelf will retain any liquid that spills or condenses on the shelf and channel it through the apertures to items directly below on a lower shelf.

U.S. Pat. No. 3,640,229 (Bell) is directed to a shelf-like pallet formed from a plastic sheet. This structure does not have perforations or slots, but instead has hollow legs and stiffening members designed to give strength to the pallet. These legs and stiffening members do not provide ventilation to objects placed thereon. The drawing of the Bell patent illustrates a flange which, in part, has a level lower than the support surface of the pallet. The flange is described as improving the overall rigidity of the load supporting structure, but does not provide drainage. The flange is designed to form a peripheral lip at the edge of the load supporting portion to restrict sliding movement of a load. Thus, the lip or edge of the pallet would not provide drainage at a level lower than the plane supporting the objects placed on the pallet.

Shelves of the types to which the patents discussed above relate all have disadvantages which center around the inability adequately to provide for liquid drainage, while permitting free circulation of air or other ambient fluid to items which rest upon the shelves.

SUMMARY OF THE INVENTION

It is a principal object of the present invention to provide solutions to many problems encountered with types of shelving presently in use and described above.

In accordance with a preferred embodiment, the shelf of the present invention comprises a single piece of molded material such as plastic, thus avoiding disadvantages associated with metal shelving, such as multi-piece construction, corrosion and the like. The single piece of plastic is molded with internal periodic rib sections that extend upwardly from a base, each rib section being formed by inverted V-shaped slots that promote free air circulation to the underside of any item resting on the shelf. These periodic rib sections also define a system or network of channels that run parallel to and between rib sections. The channel system further encourages free circulation of air or other ambient fluid about articles resting on the shelf while permitting drainage of liquid away from the articles. A peripheral flange is provided along the edge of the shelf, extending upwardly to a level slightly lower than the upward extremes of the rib sections. Since the flange is lower than the rib sections liquid drainage will occur from the outer edge of the shelf instead of through the slots in the rib sections and therefrom to the tops of items placed directly below on a lower shelf. Additionally, the flange also promotes free circulation of air to the bottoms of stored items.

In the preferred embodiment, the rib sections may also provide irregular or undulating surfaces to aid in the free circulation of air under stored items.

Other objects, aspects, and advantages ot the present invention will become apparent from the following detailed description of the preferred embodiment taken in conjunction with the accompanying drawing.

DESCRIPTION OF THE PREFERRED EMBODIMENTS

The present invention provides shelf structures that have durability and offer free circulation of air to items stored on them. The present invention also provides shelf structures that foster drainage of liquid away from stored items and prevent or mitigate against drained liquid from falling on items stored on lower shelf structures. Liquid that exceeds the drainage level is directed to the outer periphery of the shelf structure so that there is little, if any, drainage directed onto lower shelf structures. Any items stored on the shelf of the present invention rest at a level above regions that collect liquid spills and also above the peripheral edge of the shelf. Additionally, the shelf structure of the invention promotes circulation of air about items stored thereon by providing an undulating support surface that is only intermittently in contact with supported items.

Figure 1:
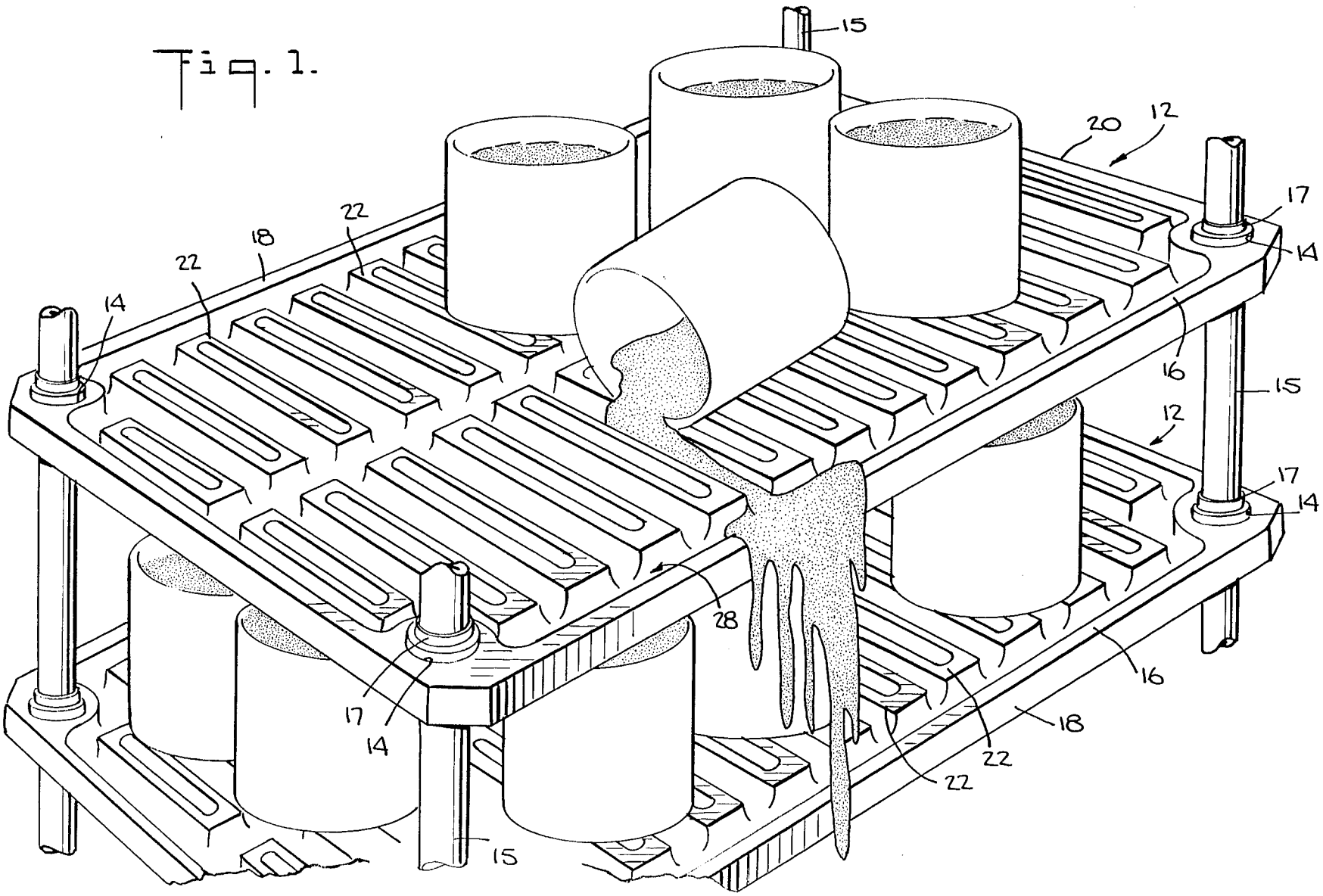
FIG. 1 is a perspective view of an assembly of two shelves in accordance with the present invention and four supporting corner posts showing how articles may be supported and how liquid may drain from the shelf periphery.
Figure 2:
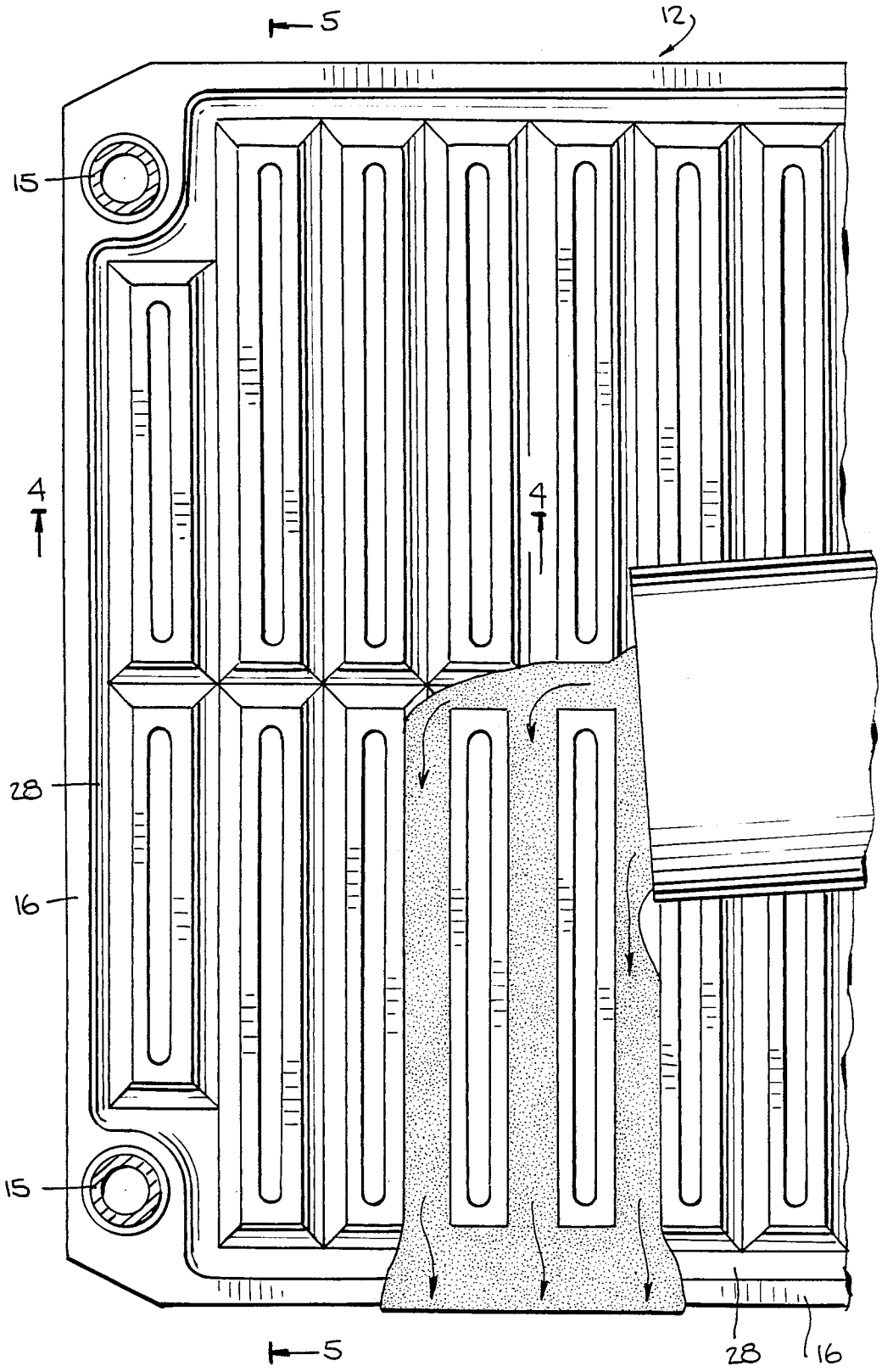
FIG. 2 is a partial top plan view of one molded plastic shelf fabricated in accordance with this preferred embodiment of the present invention.

FIGS. 1 and 2 are perspective and plan views of shelves 12 in accordance with a preferred embodiment of the present invention. The shelf 12 is preferably made of molded plastic to provide resistance to rust, corrosion, etc. However, the design of the present invention may be adapted to various other types of materials and event to metals for certain applications. In the preferred embodiment the shelf 12 includes four frusto-conical sleeves 14, each disposed at one corner for receiving and being supported on a vertical corner post 15 through a mating frusto-conical collar 17. The shelf support system including the corner posts, sleeves and collars is of the type described, for example, in U.S. Pat. Nos. 3,424,111 (Maslow) and 3,523,508 (Maslow), assigned to the assignee of the subject invention and which are incorporated herein by reference. However, other systems may be used to support a shelf incorporating the principles of the present invention.

It is not necessary that the shelf 12 be supported at its four corners, but may be supported at different positions by greater or fewer parts. Each sleeve 14 may be molded with shelf 12 or secured to it in any other suitable way. The shelf is formed with a peripheral flange 16 that runs along two sets of parallel sides 18 and 20 of the shelf. Although the periphery of the shelf defined by the flange 16 is illustrated as being rectangular, the present invention is not limited to a shelf of rectangular shape. Rather, the shelf may be of any shape needed to meet the requirements of particular applications.

Figure 3:
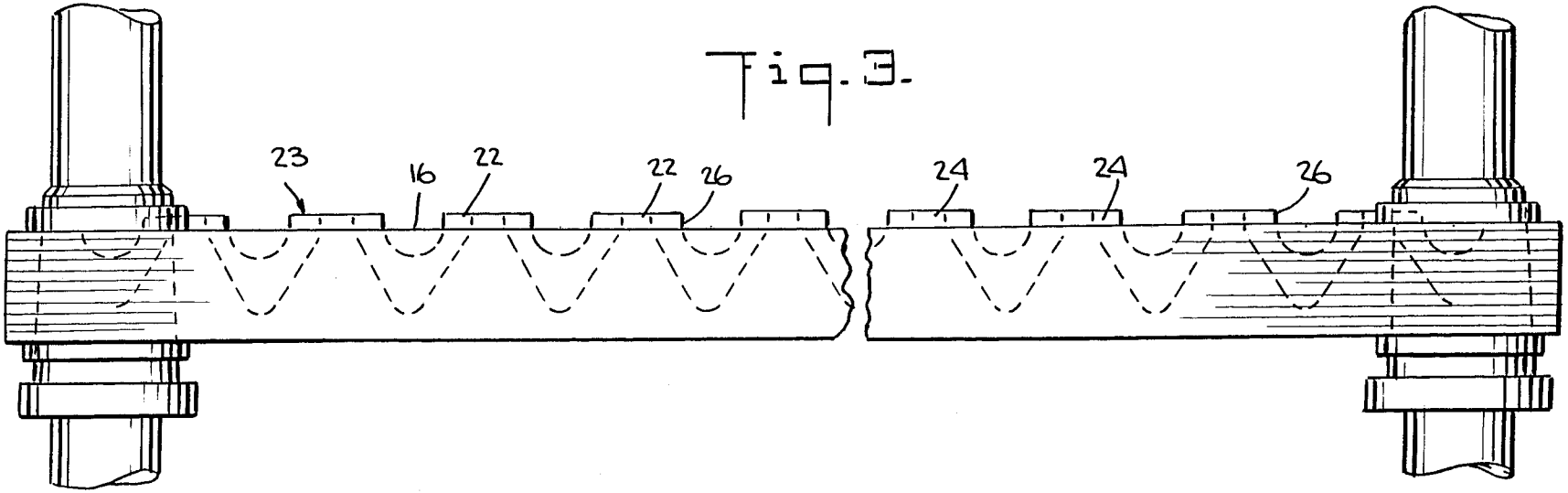
FIG. 3 is a side elevational view of this shelf.
Figure 4:
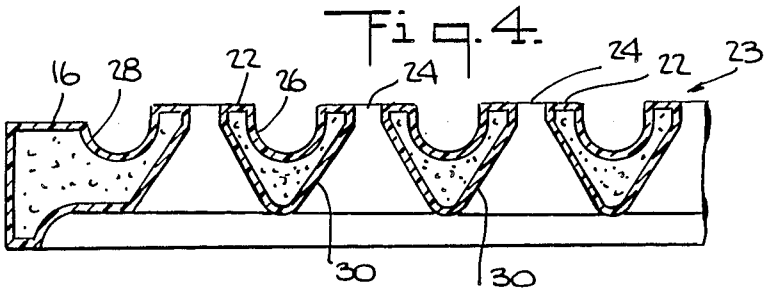
FIG. 4 is a partial cross-sectional view of the shelf of the present invention taken on plane 4—4 in FIG. 2.
Figure 5:
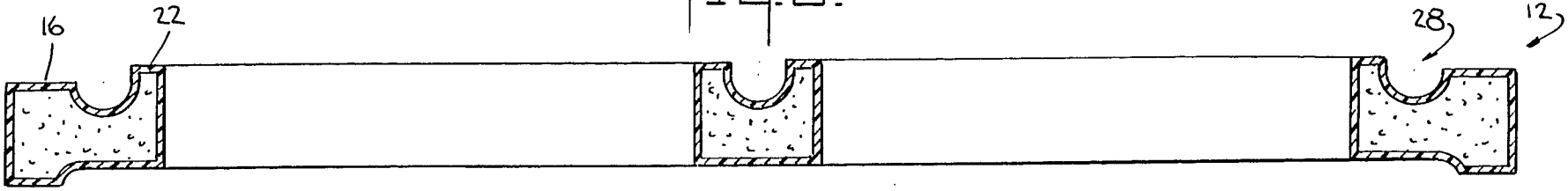
FIG. 5 is a cross-sectional view of the shelf of the present invention taken on plane 5—5 in FIG. 2.

The shelf is also formed with a plurality of upstanding rib sections 22 that define an elevated item-supporting surface on which items may be placed so that the support surface is at a level higher than that of the peripheral flange 16, as shown best in FIGS. 3 to 5. As shown in detail in FIGS. 1, 2, and 4, rib sections 22 have longitudinal slots 24 formed therein, with each rib section defining a continuous boundary 23 about one slot to provide free circulation of air to any items which may be placed on rib sections 22. Disposed between adjacent rib sections 22 are downwardly enclosed semi-circular shaped channels 26 each having a floor 27 at a vertical level below the boundaries 23 defined by the rib sections 22. The channels together define a channel network and generally run parallel to and between rib sections 22 to provide drainage areas for items stored on rib sections 22. This arrangement is particularly useful if items are stored on rib sections 22 of shelf 12 to facilitate rapid cooling or heating. Particularly, to minimize the possibility of bacterial growth, it is desirable to rapidly cool foods that have been cooked to safe low storage temperature of for example 40° F. or less.

As can clearly be seen in FIGS. 1, 2, and 4, a single channel or groove 28 extends parallel to flange 16 and is joined to the channel network at a vertical level below the upper edge 19 of the flange 16 thereby to act as a conduit between channels 26 and provide drainage access to the upper edge 19 of the flange 16 That is, as shown in detail in FIGS. 1 and 2, the groove 28 and channel network together define a continuous upwardly open liquid supporting and confining cavity that directs liquid to the upper edge 17 of the flange 16.

Referring specifically to FIG. 4, slots 24 in rib section 22 merge with openings 30 that have a triangular cross sectional shape that narrows to a neck that defines slots 24. The openings 30 provide an area for free circulation of air from below to any item which may be stored on shelf 12 through slot 24. As can be seen from FIG. 4, channels 26 are positioned so that additional air circulation is provided for any items on shelf 12 and also provide space for a moderate amount of liquid which may drain from the stored items. As drainage increases, channels 26 and connecting channel 28 will fill and when the drainage exceeds the amount capable of being accommodated in channels 26 and channel 28, the drainage will spill over flange 16 before it reaches the height of rib sections 22 since both rib sections 22 and collars 14 extend upwardly to a level higher than flange 16 as shown in FIG. 1. This prevents a majority of liquid drainage from spilling onto the area directly below any one shelf 12 through slots 24.

Figure 6:
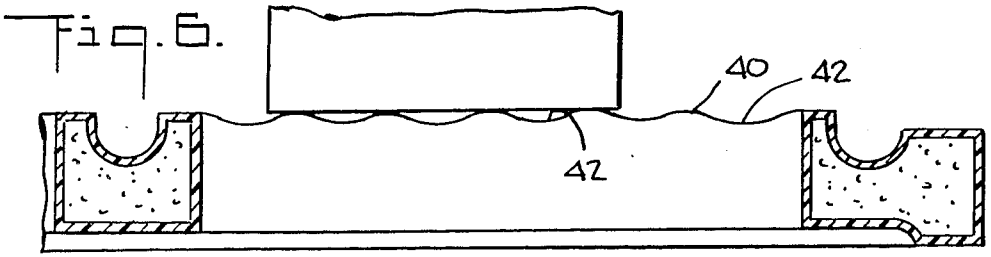
FIG. 6 is a partial cross-sectional view similar to FIG. 5 and showing another embodiment.

Referring now to FIG. 6, a side view of an alternate arrangement for rib section 22 is illustrated. An irregular surface, which is shown in exaggerated form for purposes of illustration, is provided for the portion of rib section 22 extending above flange 16. The surface illustrated has a top surface 40 with notches 42 spaced along surface 40 to provide a scalloped configuration allowing fluid communication between channels 26 and slots 24. This arrangement provides increased air flow to the bottom or underside of any item which may be stored on shelf 12. The notches on rib sections 22 may be of any shape needed to meet the requirements of particular applications. However, the lowest portion of notch 42 must be located at a height above the height of flange 16 to assure that any excess drainage from stored items is directed over flange 16 away from items stored beneath shelf 12.

FIG. 1 illustrates a shelf 12 mounted on right cylinder corner posts 15. Rib sections 22 having longitudinal slots 24 are configured to support any items stored on shelf 12. The combination of slots 24 and channels 26 provide free circulation of air to the underside of stored items. Again free circulation of air allows rapid cooling or heating of items. Locating flange 16 at a position lower than rib sections 22 not only aids drainage as previously described, but also provides an exhaust area for air chilled by cold items and an intake for cool air to replace rising air from hot items. Thus, the positioning of flange 16 augments free circulation of air to items stored on shelf 12. This shape also facilitates cleaning. Slots 24 are shaped to aid drawing air up and to aid in permitting exhaust of cool air. The triangular shape of slots 24 promotes circulation of gases while restricting communication of liquids. This shape also facilitates cleaning of the shelf. Slots 24 comprise a small percentage of the area covered by any stored items. Thus, any liquid drainage incident on slots 24 will be from a small percentage of the area of stored items supported on the rib sections 22. Drainage from the remainder of the area of the stored items will occur on rib sections 22 or above channels 26, and will ultimately flow to channels 26 and channel 28. Before liquid builds up to the point where gas communication to the bottom of stored items is blocked, the liquid will spill over flange 16.

The present invention provides advantages over known structures. For example, positioning the rib sections above the external flange assures free air circulation to stored items while providing adequate liquid drainage. The channel system illustrated serves the purposes of allowing air circulation and permitting controlled liquid drainage. The slot system augments the function of the channel system by providing air to portions of the bottom of stored items while restricting the amount of liquid drainage falling on items below the shelf.

Accordingly, although specific embodiments of the present invention have been described above in detail, it is to be understood that this is for purposes of illustration. Modifications, which will readily suggest themselves to those skilled in the art, may be made to the preferred embodiments without departing from the invention described herein.

What is claimed is:

1. A shelf for storing, in a generally horizontal attitude thereof, an item thereon, said shelf comprising:

a base structure including (a) a plurality of upstanding rib sections that together define a generally flat discontinuous upper item-supporting surface, at least some of said rib sections each being formed with an associated downwardly open slot therethrough, each of said at least some rib sections thereby defining a continuous upper boundary about said slot associated therewith, and (b) a plurality of downwardly enclosed upwardly open channels each extending between adjacent ones of said plurality of rib sections and having a floor at a level below all of said upper boundaries, defined by each of said at least some of said rib sections, said floors of all of said channels being interconnected thereby to define a channel network;

a peripheral upstanding flange extending around the periphery of said base structure and having an upper edge at least a portion of which is at a vertical level lower than all of said upper boundaries defined by said at least some of said rib sections; and a continuous groove-forming member adjacent said flange and joined to said channel network at a vertical level below said portion of said edge of said flange;

said groove-forming member and said channel network defining a continuous liquid supporting and confining cavity, whereby liquid spilled into a channel in said channel network will overflow through said portion in said upper edge before such liquid can overflow through a slot in any one of said rib sections.

2. The shelf according to claim 1, wherein each of said slots has a cross-sectional shape that is wide at the bottom and narrows to a neck near the top and which opens along the length of each of said at least some of said rib sections.

3. A shelf according to either of claims 1 or 2, wherein said base structure includes means for mounting said shelf on support structure.

4. A shelf according to claim 1, wherein said base structure includes at least one element for supporting said shelf at a predetermined height on a support structure.

5. A shelf according to claim 4, wherein said at least one element extends upwardly to a height greater than the vertical level of said portion of said flange.

6. A shelf according to any of claims 1, 4 or 5, wherein said rib sections are formed with an upper surface, defining said upper boundary, having an irregular contour.

7. A shelf according to claim 6, wherein said irregular contour comprises a scalloped surface.

8. A shelf according to claim 1, wherein substantially all of said upper edge of said flange is at said vertical level lower than all of said upper boundaries defined by said at least some of said rib sections.

9. A shelf according to claim 1, wherein each of said rib sections is formed with one said slot therein.

10. A method for storing items comprising the steps of:

providing a base structure including (a) plurality of upstanding rib sections that together define a discontinuous generally flat upper item-supporting surface, at least some of said rib sections each being formed with an associated downwardly open slot therethrough, each of said at least some rib sections thereby defining a continuous upper boundary about said slot associated therewith, and (b) a plurality of downwardly enclosed upwardly open channels each extending between adjacent ones of said plurality of rib sections and having a floor at a level below all of said upper boundaries defined by each of said at least some of said rib sections, said floors of all of said channels being interconnected thereby to define a channel network;

providing a peripheral upstanding flange extending around the periphery of said base structure and having an upper edge at least a portion of which is at a vertical level lower than all of said upper boundaries defined by said at least some of said rib sections;

providing a continuous groove-forming member adjacent said flange and joined to said channel network at a vertical level below said portion of edge of said flange;

said groove-forming member and said channel network defining a continuous liquid supporting and confining cavity;

placing an item on said item-supporting surface above at least one said rib section having a slot therethrough;

circulating air through said slot and about said item; and overflowing any liquid spilled into a channel in said channel network through said portion in said upper edge of said flange before such liquid can overflow through a slot in any one of said rib sections.

11. A method according to claim 10, further comprising the steps of:

providing each of said rib sections having a slot formed therein with an upper surface, defining said upper boundary, having an irregular non-planar contour; and circulating air between said item and said rib section over said upper surface of each said rib section having a slot formed therein.

* * * * *

UNITED STATES PATENT AND TRADEMARK OFFICE

CERTIFICATE OF CORRECTION

PATENT NO. : 4,843,975

DATED : July 4, 1989

INVENTOR(S) : JOHN H. WELSCH, ET AL.

It is certified that error appears in the above-identified patent and that said Letters Patent is hereby corrected as shown below:

On the title page:

IN [56] REFERENCES CITED

U.S. PATENT DOCUMENTS, "Strob et al." should read --Streb et al.--.

COLUMN 1

Line 13, "avialable" should read --available--.
Line 28, "drain out to" should read --drain onto--.

COLUMN 2

Line 19, "sections" should read --sections,--.
Line 31, "drawing." should read --drawings.--.
Line 42, "shelf;" should read --shelf.--.

COLUMN 3

Line 37, "slot" should read --slot,--.
Line 41, "channels 26" should read --channels 26,--.
Line 55, "upper edge 19" should read --upper edge--.
Line 57, "upper edge 19" should read --upper edge--.
Line 63, "cross" should read --cross- --.

COLUMN 4

Line 9, "collars 14" should read --collars 17--.
Line 34, "provide" should read --provides--.

--

UNITED STATES PATENT AND TRADEMARK OFFICE

CERTIFICATE OF CORRECTION

PATENT NO. : 4,843,975

DATED : July 4, 1989

INVENTOR(S) : JOHN H. WELSCH, ET AL.

It is certified that error appears in the above-identified patent and that said Letters Patent is hereby corrected as shown below:

COLUMN 5

Line 50, "support structure." should read --a support structure.--.

COLUMN 6

Line 13, "plurality" should read --a plurality--.
Line 36, "edge" should read --said edge--.

Signed and Sealed this

Twenty-third Day of April, 1991

*Attest:*

HARRY F. MANBECK, JR.

*Attesting Officer*

*Commissioner of Patents and Trademarks*